US005931656A

United States Patent [19]

Kanno

[11] Patent Number: 5,931,656

[45] Date of Patent: Aug. 3, 1999

[54] GAS LIGHTER WITH INTERRUPTED GAS VALVE ACTUATOR MEANS FOR PROVIDING CHILD RESISTANCY

[75] Inventor: Minoru Kanno, Shizuoka-ken, Japan

[73] Assignee: Tokai Corp., Tokyo, Japan

[21] Appl. No.: 08/980,039

[22] Filed: Nov. 26, 1997

[30] Foreign Application Priority Data

Mar. 28, 1997 [JP] Japan ..... 9-076836
May 29, 1997 [JP] Japan ..... 9-139899

[51] Int. Cl.[6] ..... F23D 11/36

[52] U.S. Cl. ..... 431/153; 431/255

[58] Field of Search ..... 431/153, 277, 431/255

[56] References Cited

U.S. PATENT DOCUMENTS 5,002,482 3/1991 Fairbanks et al. ..... 431/153
5,197,870 3/1993 Yang ..... 431/153
5,271,731 12/1993 Hsin-Chung ..... 431/153
5,324,193 6/1994 Pan ..... 431/153
5,387,101 2/1995 Chan ..... 431/277
5,704,776 1/1998 Sher ..... 431/153

*Primary Examiner*—Carl D. Price
*Attorney, Agent, or Firm*—George W. Finch

[57] ABSTRACT

A gas lighter is provided which is highly reliable and cannot release fuel gas even when its actuation member is depressed, as long as a child resistant locking device has not been moved to its unlocking position. The gas lighter includes a fuel-supplying device for supplying fuel gas to a nozzle through a valve mechanism, an action lever, which must be rotated about a rotation axis to open and close the valve mechanism of the fuel-supplying device, an igniter for igniting fuel gas discharged through the nozzle, and the actuation member, which when depressed drives the igniter. An unlocking member is normally held in a locking position where it holds the rotation axis of the action lever in a first position where depression of the actuation member cannot rotate the action lever to open and close the valve mechanism. The unlocking member is movable to an unlocking position to move the rotation axis of the action lever to a second position where rotation of the action lever by the actuation member can open and close the valve mechanism.

54 Claims, 12 Drawing Sheets

GAS LIGHTER WITH INTERRUPTED GAS VALVE ACTUATOR MEANS FOR PROVIDING CHILD RESISTANCY

BACKGROUND OF THE INVENTION

1. Field of the Invention

This invention relates to a child resistant gas lighter in which fuel gas is discharged and ignited in response to manual depression of of an actuator or pressing member interuptably operatively connected to release fuel gas for ignition when the lighter is armed and is operatively disconnected when the lighter is disarmed to prevent the release of the fuel gas when the actuator is accidentally pressed or pressed intentionally by a child who is unable to determine the arming sequence. The invention is particularly difficult for an adult, in an attempt to make the lighter easier to use, to permanently disable the child resistant nature of the lighter without destroying the lighter's ability to produce a flame.

2. Description of the Related Art

Typical child resistant lighters, where release of fuel gas is interrupted, are shown in U.S. Pat. Nos. 5,324,193 and 5,431,558. U.S. Pat. No. 5,324,193 discloses a fuel gas actuator lever with a sliding pivot. To release gas, the user must first slide the lever toward the nozzle to remove the abutment between a tab, which extends downwardly from operator side of the lever, and an abutment surface. Adults can permanently disable the child resistant feature either by breaking the tab off the lever or by filing a suitable slope on the abutment surface. U.S. Pat. No. 5,431,558 is similar requiring an inward sliding motion of the fuel gas actuator lever to move blocking surfaces out of alignment so that the lever can be depressed. An adult can permanently disable the child resistant feature, but because the blocking surfaces are toward the interior of the lighter, a more careful filing job must be accomplished to defeat the child resistancy feature than is required for the lighter disclosed in U.S. Pat. No. 5,324,193.

U.S. Pat. No. 5,458,482 discloses a gas lighter comprising a fuel-supplying device for supplying fuel gas to a nozzle on the top of a lighter main body for storing the fuel gas, an action lever for opening and closing the fuel-supplying device by moving the nozzle up and down, a pressing member which is depressed to operate a piezoelectric unit, and an elastic piece which is disposed on the top of the lighter main body, the elastic piece being normally held in a position where it interferes with the pressing member to prevent depression thereof and being deformed to permit depression of the pressing member in response to movement of a slide member. Removal of the elastic piece defeats the child resistancy of the lighter.

For the lighters described above, however, it is difficult to switch from a locked position, where a flame cannot be created, to an unlocked position, where a flame can be created. In other words, the use of the lighters is not convenient. In addition, the structure of the lighters is relatively complicated. When the locking device used to block the pressing device for supplying the fuel gas does not operate very well for some reason, the pressing device can still be pressed downward to spray the fuel gas by accident. In addition, users of lighters can break the locking device of the lighter for convenience to defeat the child resistant properties of the lighter. In fact adult users of lighters including U.S. Government mandated child resistancy features even go so far as to use the operating aid of U.S. Pat. No. 5,562,439, to make the lighters easier to use by defeating the child resistancy features.

SUMMARY OF THE INVENTION

In accordance with a first aspect of the present invention, there is provided a gas lighter comprising a lighter main body for storing fuel gas, a fuel-supplying means for supplying the fuel gas from the main body to a nozzle through a valve mechanism, an action lever, which is rotated about a rotation axis to open and close the valve mechanism of the fuel-supplying means, an ignition means for igniting the fuel gas discharged through the nozzle, and a pressing member, which is depressed to drive the action lever and the ignition means. The mechanism that provides child resistancy in the lighter includes an unlocking member, which is normally held in a locking or disarmed position where it holds the rotation axis of the action lever in a first position. When the axis is in the first position, the action lever cannot open and close the valve mechanism. When the unlocking member is moved to an unlocking or armed position, it moves the rotation axis of the action lever to a second position where the action lever can open and close the valve mechanism.

In the gas lighter of the first aspect, it is preferred that the latter half of the downward movement of the pressing member after ignition be used to return the unlocking member from the unlocking position back to the locking position to disarm and return the action lever back to the first position.

Further it is preferred that a retainer member for urging the rotation axis of the action lever toward the first position be provided close to the action lever. The action lever may also carry an engaging protrusion so that when the rotation axis of the action lever is in the first position, a part of the pressing member is brought into engagement with the engaging protrusion in the course of depression of the pressing member to prevent further depression of the pressing member.

The pressing member may be arranged so that the pressing member cannot be brought into contact with the action lever when the rotation axis of the action lever is in the first position.

For example, the rotation axis of the action lever may be moved between the first position and the second position under the guidance of a guide groove. The guide groove may be provided with a semicircular supporting portion in an upper end portion thereof and the rotation axis of the action lever may be held in the supporting portion in the second position.

Further the unlocking member is preferably arranged so that movement of the unlocking member from the locking position to the unlocking position requires an auxiliary action in a direction different from that of the action to move the unlocking member from the locking position to the unlocking position.

For example, the action to move the unlocking member from the locking position to the unlocking position may be in the vertical direction, and the auxiliary action may be an action to push the unlocking member toward the lighter body. Specifically, the unlocking member may comprise an operating part in the form of a curved elastic plate and a protrusion which is in engagement with the lighter body to prevent up and down movement of the unlocking member when the unlocking member is in the locking position and is disengaged from the lighter body to permit up and down movement of the unlocking member when the operating part is pushed toward the lighter body.

In accordance with a second aspect of the present invention, there is provided a gas lighter comprising a lighter main body for storing fuel gas, a fuel-supplying means for supplying the fuel gas from the main body to a nozzle through a valve mechanism, an action lever which is rotated about a rotation axis to open and close the valve mechanism of the fuel-supplying means, an ignition means for igniting the fuel gas discharged through the nozzle, and a pressing member which is depressed to drive the action lever and the ignition means, wherein the improvement comprises an unlocking member which is normally held in a locking position where it holds the rotation axis of the action lever in a first position where the action lever cannot open and close the valve mechanism and is movable in the transverse direction with respect to the lighter main body to an unlocking position to move the rotation axis of the action lever to a second position where the action lever can open and close the valve mechanism, and a return spring which urges the unlocking member toward the locking position.

It is preferred that the unlocking member be locked in the unlocking position by a locking member and released from the locking member in response to depression of the pressing member.

In the gas lighter in accordance with the first aspect of the present invention, so long as the unlocking member is in the locking position, where it is normally held, the fuel gas can be neither discharged nor ignited even if the pressing member is depressed since the rotation axis of the action lever is held in the first position where the action lever cannot act on the valve mechanism. When the unlocking member is moved to the unlocking position, the rotation axis of the action lever is moved to the second position where the action lever can act on the valve mechanism to open it and accordingly the fuel gas can be discharged and ignited in response to depression of the pressing member.

When the unlocking member is arranged so that it is automatically returned to the locking position by further downward movement of the pressing member after ignition, the lighter can be re-locked without failure.

Further when a retainer member for urging the rotation axis of the action lever toward the first position is provided, the rotation axis of the action lever can be surely returned to the first position, where the fuel gas cannot be discharged, after quenching.

Further when the action lever is provided with an engagement protrusion which prevents depression of the pressing member when the rotation axis of the action lever is in the first position, the user can actually recognize that the lighter is locked.

On the other hand, when the pressing member is arranged so that the pressing member cannot be brought into contact with the action lever when the rotation axis of the action lever is in the first position, the lighter can be locked while preventing the action lever and the like from being subjected to a large force even though strong force is applied to the pressing device.

Further when the unlocking member is arranged so that movement of the unlocking member from the locking position to the unlocking position requires an auxiliary action in a direction different from that of the action to move the unlocking member from the locking position to the unlocking position, the operation of the unlocking member is complicated to increase safety of the lighter. Thus, careless lighting or lighting by someone without the mental capacity to be trusted with a flame, can be prevented. Especially when the unlocking member is arranged so that it can be moved only when it is pushed toward the lighter body and then in the vertical direction, such arrangement can be realized by a simple structure by use of a curved elastic operating part.

In the gas lighter in accordance with the second aspect of the present invention, the lighter cannot be ignited until the unlocking member is transversely moved to the unlocking position.

Further with the arrangement where the unlocking member is locked in the unlocking position by a locking member and released from the locking member in response to depression of the pressing member, the action lever can be surely held in the second position when the fuel gas is to be discharged and ignited, whereby operation of the lighter can stabilized.

Therefore, an object of the present invention is to provide a gas lighter in which the fuel gas cannot be discharged even if the pressing member can be depressed unless a lock releasing operation by a lock releasing member has been effected completed.

Another object is to provide reliable and easy to operate lighter with child resistant features that are difficult for an adult to permanently defeat.

Another object is to provide a child resistant lighter that seems to operate normally but will not produce a flame unless armed before the lighting operation is started.

Another object is to provide a child resistant lighter that may provide tactile feedback of its locked or unlocked condition;

Another object is to provide a child resistant lighter that may seem to operate normally when locked, yet no release of fuel is produced;

Another object is to provide a child resistant lighter that can be constructed in different embodiments to vary the difficulty of arming;

Another object is to provide a child resistant lighter that can be constructed to meet the regulations for such lighters in different jurisdictions.

These and other objects and advantages of the present invention will become apparent to those skilled in the art after considering the following detailed specification, together with the accompanying drawings wherein:

DESCRIPTION OF THE PREFERRED EMBODIMENTS

First Embodiment

Figure 1:
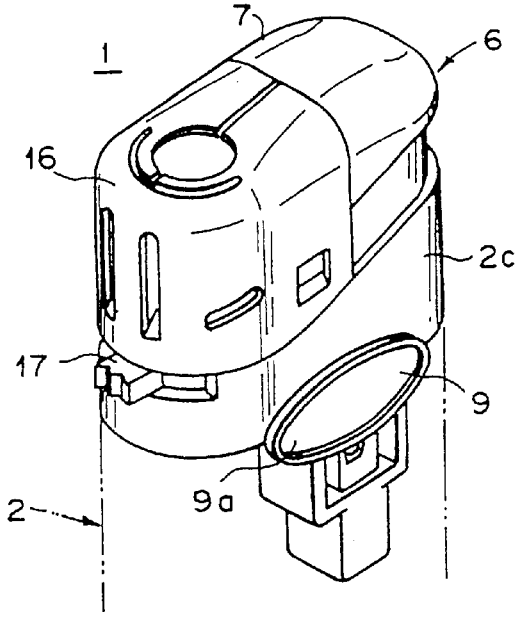
FIG. 1 is a perspective view of the upper portion of a gas lighter in accordance with a first embodiment of the present invention.

Referring to the figures more particularly by reference numbers, FIGS. 1 to 7 show a gas lighter 1 in accordance with a first embodiment of the present invention, which is of an electric discharge ignition type. The gas lighter includes a lighter main body 2 for storing fuel gas, a fuel-supplying device 4 including a nozzle 3 and a valve mechanism 14, an action lever 15 connected to the nozzle 3 for opening and closing the valve mechanism 14 by lifting the nozzle 3 of the fuel-supplying device 4, an operating cap 7 which forms a pressing member 6 which drives the action lever 15 and igniting means 5, shown formed by a piezoelectric unit 18, to ignite fuel gas discharged through the nozzle 3, and a switching mechanism 8 which is provided with an unlocking member 9 for moving a pivot pin 15*a* of the action lever 15 on which the action lever 15 is supported for rotation from an inoperable position to an operable position for controlling the fuel gas.

Though not shown in detail in the figures, the lighter main body 2 of the lighter 1 includes a rectangular tank body 2*a* formed of synthetic resin and a cap 2*b* fixed and sealed on the top of the tank body 2*a* to form therebetween a tank for containing fuel gas such as butane. A middle case 2*c* is fitted in the upper portion of the tank body 2.

The fuel-supplying device 4 is mounted on the cap 2*b* of the main body 2. The valve mechanism 14 of the fuel-supplying device 4 is of a known structure for controlling the discharge rate of the fuel gas. The nozzle 3 of the fuel-supplying device 4 projects upward at the center of the valve mechanism 14. The action lever 15 is L-shaped and is provided with an engagement groove 15*b* in one end portion thereof for permanent engagement with the nozzle 3 when the lighter 1 is assembled.

Figure 4A:
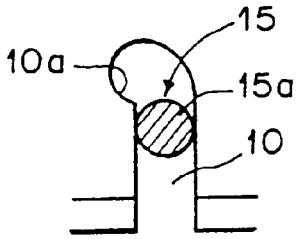
FIGS. 4A and 4B are enlarged detail views showing the relationship between the axis of action lever and the guide groove in different states.
Figure 4B:
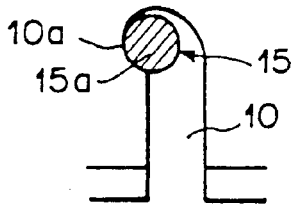

The action lever 15 has a pivot pin 15*a* extending sidewardly from the intersection of its leg parts 15*c* and 15*d*, which is inserted into a pair of guide grooves 10 formed on the middle case 2*c* of the lighter main body 2. Each of the guide grooves 10 has a semicircular supporting portion 10*a* on its top as shown in FIGS. 4A and 4B. When the pivot pin 15*a* is in the semicircular supporting portions 10*a,* the action lever 15 can be rotated about the axis of the pivot pin 15*a*. When the pivot pin 15*a* is in the semicircular portions 10*a,* the leg portions 15*c* of the action lever 15 (the other end portion opposite to the engagement groove 15*b*) extends obliquely downward allowing the action lever 15 to provide an operative connection between the pressing member 6 and the nozzle 3. When the action lever is rotated about the axis of the pivot pin 15*a* and the nozzle 3 is lifted, the valve mechanism 14 is opened and the fuel gas is discharged from the nozzle 3.

Further the gas lighter 1 of this embodiment is provided with a windshield cap 16 disposed around the nozzle 3 and an adjusting ring 17 for adjusting the flame by changing the discharge rate of the fuel gas.

The operating cap 7 located on the top of lighter main body 2 (middle case 2*c*) opposite to the nozzle 3 has a tubular bottom portion fitted on the top of the piezoelectric unit 18 of the igniting means 5 and can be pressed downward to activate the piezoelectric unit 18.

A discharging electrode 19 electrically connected to the piezoelectric unit 18 of the igniting means 5 is mounted on the operating cap 7 and connected to the piezoelectric unit 18 by means of a wire. By pressing the piezoelectric unit 18, a high voltage is generated and discharged between the discharging electrode 19 and the nozzle 3 as a spark, which is used for ignition.

When the operating cap 7 is pressed downward, the upper part of the piezoelectric unit 18 also is moved downward. On the moving part of the piezoelectric unit 18, there are lever press protrusions 20, which are adapted to slide on and press the leg portions 15*c* of the action lever 15 sidewardly to pivot the action lever 15. With this arrangement, in response to depression of the operating cap 7, the lever press 20 pivots the action lever 15, which is in a second position (to be described later) to discharge the fuel gas from the nozzle 3. In response to further depression of the operating cap 7, the igniting means 5 are operated to ignite the fuel gas by means of the aforesaid spark discharge to the nozzle 3.

The structure of the switching mechanism 8 will be described hereinbelow. The switching mechanism 8 includes the guide grooves 10 for guiding the pivot pin 15*a* of the action lever 15 (see FIGS. 3 and 4), when the action lever 15 is moved by the unlocking member 9. The unlocking device 9, which is mounted on the main body 2 is capable of being moved upwardly and downwardly. The unlocking member 9 normally is held in a locking position (the lowermost position) where it holds the pivot pin 15*a* of the action lever 15 in a first position where the action lever 15 cannot be pivoted to open and close the valve mechanism 14 and being movable to an unlocking position (the uppermost position) to move the pivot pin 15*a* of the action lever 15 to a second position where the action lever 15 can be pivoted to open and close the valve mechanism 14 against the bias force provided by a retainer member 11 which urges the action lever 15 toward the first position.

The middle case 2*c* of the lighter main body 2 has a pair of support portions on opposite sides thereof and a partition board 21 is held between the support portions. A guide groove 10 is formed on the lower part of each of the support portions which extend in the vertical direction. The action lever 15 can move up and down along the guide grooves 10.

A semicircular supporting portion 10*a* is formed at the top of each guide groove 10 which extends away from the operating cap 7. When the pivot pin 15*a* is in the first or disarmed position, the pivot pin 15*a* is received in the vertical portion of the guide grooves 10 as shown in FIG. 4A, and when the pivot pin 15*a* is in the second or armed position, the pivot pin 15*a* is received in the semicircular supporting portions 10*a* as shown in FIG. 4B.

When the pivot pin 15*a* is in the first position, the leg portions 15*c* of the action lever 15 are in contact with the cap 2*b* of lighter main body 2 and are held stationary. On the upper part of the action lever 15 close to the pivot pin 15*a*, there is an engaging protrusion 15*d* pointing out toward the operational cap 7. On the inner surface of operational cap 7 facing the action lever 15, there is a first abutment member 7*a* extending in the vertical direction. The first abutment member 7*a* engages with the engaging protrusion 15*d* of the action lever 15 when action lever 15 is in the first position to prevent operating cap 7 from being further pressed downward from the position shown in FIG. 5 when the action lever 15 is in the first position.

The unlocking member 9 (FIG. 3) includes an outer operation part 9*a* and an inner interlock part 9*b*. The two parts 9*a* and 9*b* are connected by a connecting part 9*c* which is supported by the lighter main body 2 to be slidable up and down. The unlocking member 9 can move between the unlocking position and the locking position as described above.

A ramp 9*d* inclining away from the operational cap 7 is formed in an upper end portion of the interlock part 9*b*. The ramp 9*d* is adapted to abut against the pivot pin 15*a* of the action lever 15 from below so that the pivot pin 15*a* is lifted from the vertical portions of the guide groove 10 into the supporting portions 10*a* and then pushed away from the operational cap 7 into engagement with the supporting portions 10*a*.

The interlock part 9*b* of the unlocking member 9 further carries a stopper shoulder 9*e*. A lower end portion of a second abutment member 7*b* on the operational cap 7 is adapted to abut against the top of the stopper shoulder 9*e* from above so that when the operational cap 7 moves downward, the unlocking member 9 also moves downwardly.

A retainer member 11 in the form of an elastic plate is formed on a lower end portion of the partition board 21. The retainer member 11 is in abutment against the upper surface of the action lever 15 on the engagement groove 15*b* side of the pivot pin 15*a* in a resiliently bent state thereby urging the part of the action lever 15 downwardly.

Figure 2:
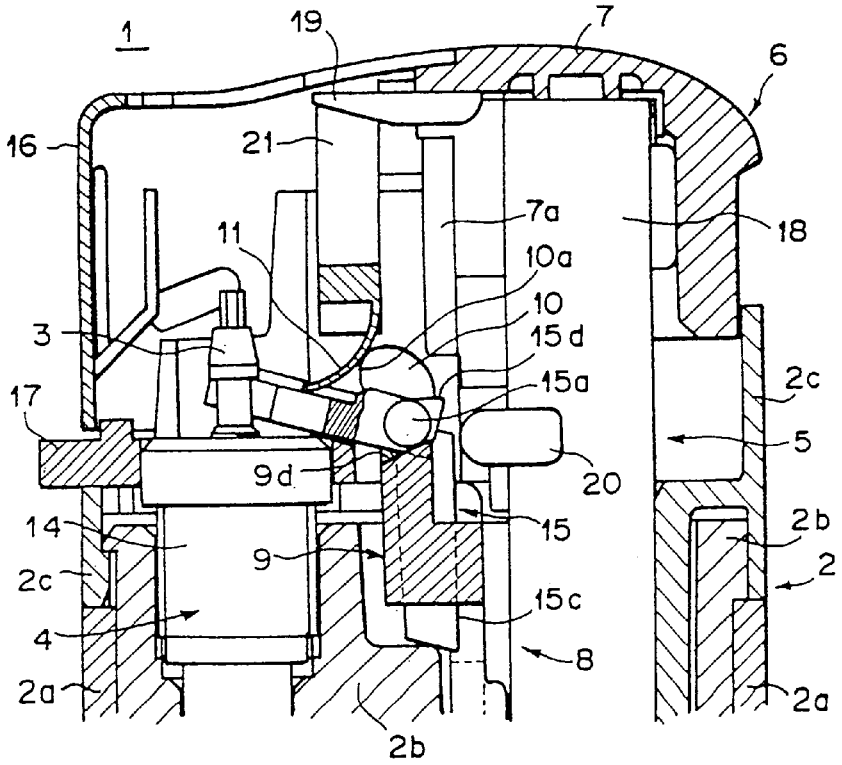
FIG. 2 is a side cross-sectional view of the upper portion shown in FIG. 1.
Figure 5:
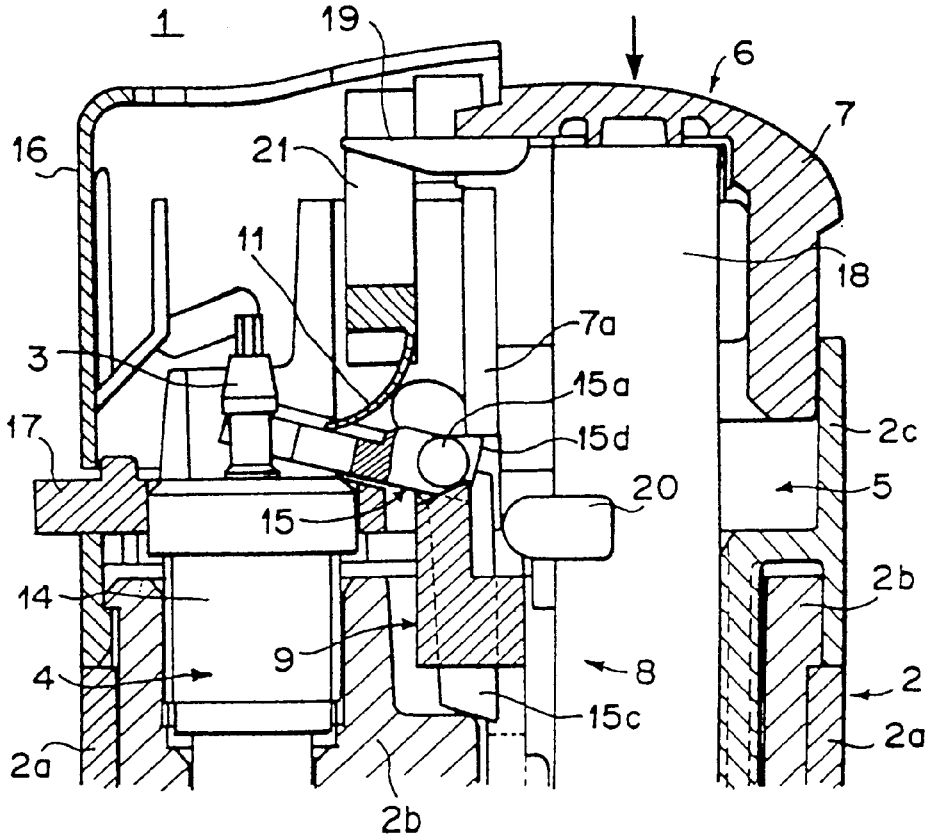
FIG. 5 is a side cross-sectional view showing the upper portion shown in FIG. 1 as a protrusion on the action lever stops downward movement of the pressing device to provide a tactile clue that the lighter is locked.

The operation of this embodiment will be described, hereinbelow. When the unlocking member 9 is in the locking or disarmed position as shown in FIG. 2, the pivot pin 15*a* of the action lever 15 is in the first position shown in FIG. 4A. In this state, the leg portions 15*c* of the action lever 15 extend substantially in the vertical direction with their lower end portions in contact with the cap 2*b*. The leg portions 15*c* are held in positions where they cannot be brought into contact with the lever press 20. When the operating cap 7 is depressed in this state, the first abutment member 7*a* on the cap 7 is brought into abutment against the engaging protrusion 15*d* on the action lever 15. Further depression of the operational cap 7 is prevented as shown in FIG. 5, the fuel gas is not released and the lighter is locked.

In case the operating cap 7 is broken in such a manner that depression of the operating cap 7 becomes feasible even if the pivot pin 15*a* is in the first position, depression of the operating cap 7 cannot rotate the action lever 15 since the leg portions 15*c* of the action lever 15 are held in positions where they cannot be brought into contact with the lever press 20 so long as the pivot pin 15*a* is in the first position. Accordingly the fuel gas is not discharged and ignited even though the piezoelectric unit 18 may discharge to produce a spark.

Figure 6:
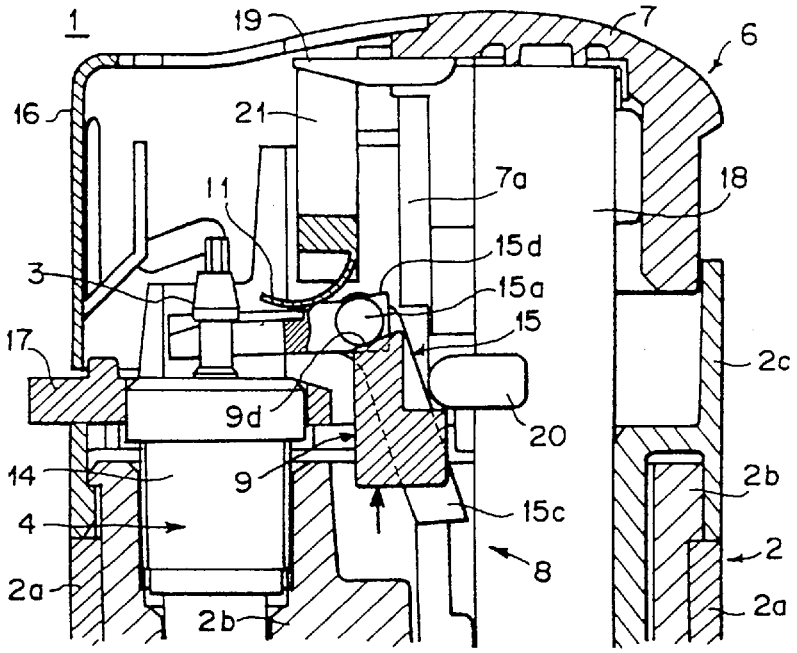
FIG. 6 is a side cross-sectional view showing the upper portion as the action lever is unlocked.

When the gas lighter 1 is to be used, the operation part 9*a* of the unlocking member 9 is pushed to the unlocking position. As shown in FIG. 4B and FIG. 6, when the unlocking member 9 is moved to the unlocking position, the ramp 9*d* on the unlocking member 9 pushes the pivot pin 15*a* of the action lever 15 upward from the vertical portions of the guide grooves 10 to the supporting portions 10*a* on the top of the grooves 10 and then forward into engagement with the supporting portions 10*a* in the second position, the action lever 15 is rotatable about the axis of the pivot pin 15*a*.

When the pivot pin 15*a* is in the second position, the first abutment member 7*a* on the operating cap 7 cannot act on the protrusion 15*d* on the action lever 15 since the action lever 15 has moved away from the cap 7. Further the portion of the action lever 15 that includes the groove 15*b* on the action lever 15 is in a substantially horizontal position and the leg portions 15*c* incline obliquely rearward where the lever press 20 can act on the leg portions 15*c*.

Figure 7:
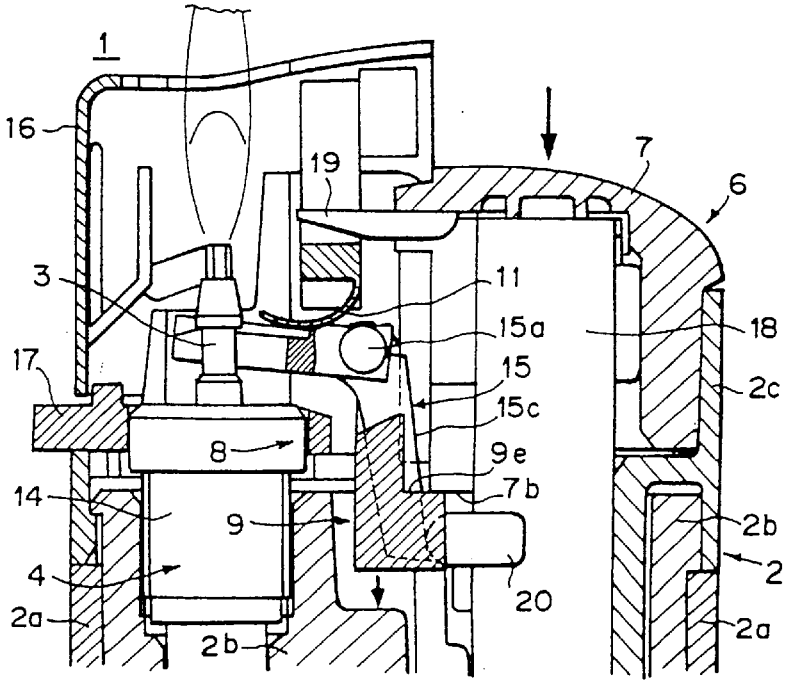
FIG. 7 is a side cross-sectional view showing the action lever after it has been pivoted to release fuel and the pressing device is moving the unlocking device so that the action lever will move to its locked position as shown in FIG. 5 when the pressing device is released.

When the operating cap 7 is pressed downward with the unlocking member 9 held in the unlocking position, the lever press 20 is brought into abutment against the leg portions 15*c* of the action lever 15 as shown in FIG. 7. This pivots the action lever 15 to open the valve mechanism 14 in the fuel supplying device 4, so that the fuel gas is discharged through the nozzle 3. At the same time, the lever press 20 drives the piezoelectric unit 18 to produce a spark and ignite the fuel gas being discharged. Further, during the latter part of the pressing action, the second abutment member 7*b* on the operating cap 7 contacts with the stopper shoulder 9*e* of the unlocking member 9 to push the unlocking member 9 downward.

When the unlocking member 9 moves downward, the ramp 9*d* on the unlocking member 9 can no longer hold the pivot pin 15*a* of the action lever 15. However, the pivot pin 15*a* of the action lever 15 is held in the second position without falling from the supporting portions 10*a* by a combined force of the counter-force to the force pushing the nozzle 3 upward and the pressing force from the lever press 20 acting on the action lever 15. Thus the valve mechanism 14 is kept open and the flame is maintained as long as the operating cap 7 is held down.

When the operating cap 7 is released to quench the flame, the operating cap 7 is returned to the original upper position under the force of a spring built in the piezoelectric unit 18 (not shown) and the like. Then the force acting on the action lever 15 to maintain its position disappears and the action lever 15 is pushed away from the supporting portions 10*a* by the force applied by the retainer member 11. Thus the pivot pin 15*a* of the action lever 15 is returned from the second position to the first position, and since the unlocking member 9 is already in the locking position, the lighter 1 is returned to the locked state.

Second Embodiment

Figure 8:
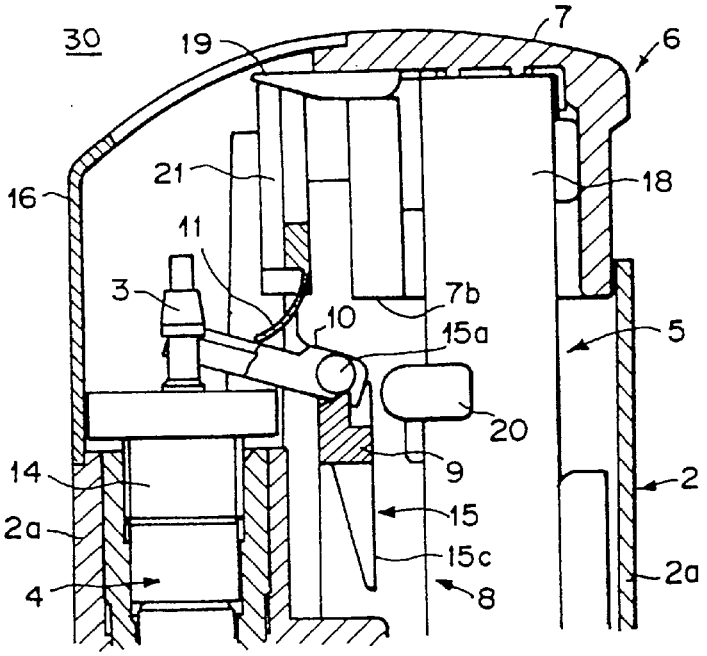
FIG. 8 is a side cross-sectional view of the upper portion of a gas lighter in accordance with a second embodiment of embodiment 2 of the present invention in its locked condition.
Figure 9:
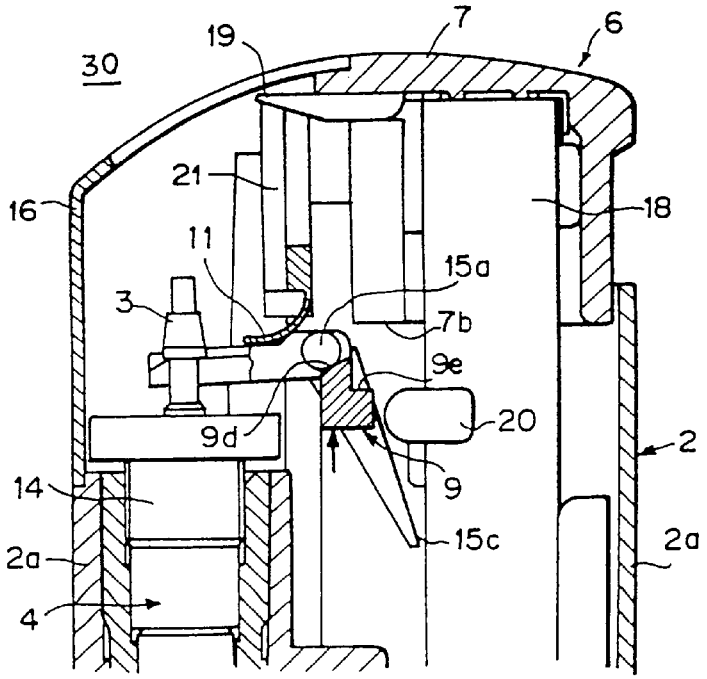
FIG. 9 is a side cross-sectional view of the upper portion shown in FIG. 8 as it is being moved to its unlocked condition.
Figure 10:
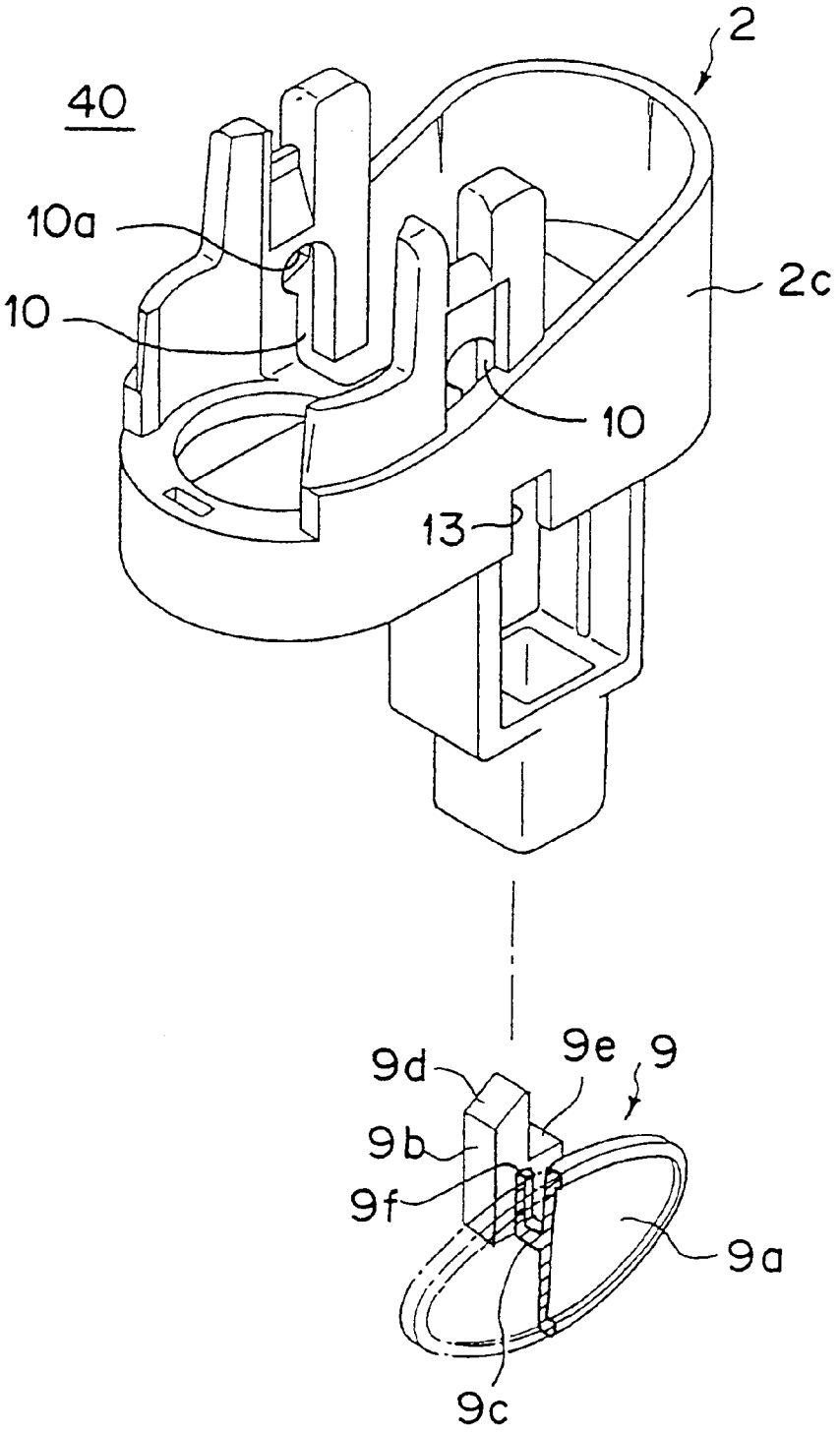
FIG. 10 is an exploded perspective view of the middle case and unlocking member of a gas lighter in accordance with a third embodiment of the present invention.

FIGS. 8 and 9 show a gas lighter 40 constructed in accordance with a second embodiment of the present invention. The parts similar to those parts of the first embodiment are numbered the same as they are with the other embodiments. The main difference of embodiment 2 is that the action lever 15 has a shape different from that in the first embodiment.

In the second embodiment, the action lever 15 does not carry the engaging protrusions 15*d* for preventing depression of the operating cap 7 when it is being pressed downward. As shown in FIG. 8, when the unlocking member 9 similar to that in the first embodiment is in the locking position, the operating cap 7 can move up and down. In this state though, the pivot pin 15*a* of the action lever 15 is in the first position shown in FIG. 4A, the leg portions 15*c* extend straight downward and cannot contact the lever press 20 even if the lever press 20 moves downward, so that the valve mechanism 14 will not be opened to release fuel gas and there is no flame.

When the unlocking member 9 is moved to the unlocking position as shown in FIG. 9, the pivot pin 15*a* of the action lever 15 is moved from the first position to the second position shown in FIG. 4B, and the leg portions 15*c* rotate to extend obliquely rearward so that the lever press 20 can act on the leg portions 15*c*. Therefore, when the operating cap 7 is pressed downward, the action lever 15 can be pivoted and the valve mechanism 14 can be opened to discharge the fuel gas, causing ignition. During the latter part of the pressing action, the unlocking member 9 moves downward, and the lighter 30 goes back to the locked position.

Unlike in the first embodiment 1 described above, when in the first position, the action lever 15 in this embodiment 30 is not required to have a a robust nature capable of resisting downward manual force applied to the operating cap 7, so that the the structure thereof can be simplified. Further, the lighter main body 2 in this embodiment 30 does not have a separate middle case 2*c*. However, tank main body 2*a* in this embodiment 30 does carry the guide grooves 10, etc. The rest of the parts of the gas lighter 30 are the same as those in the first embodiment. The elements analogous to those in the first embodiment are given the same reference numerals and will not be described here.

Third Embodiment

The gas lighter 40 of this embodiment is shown in FIGS. 10, 11A, 11B, 12A, 12B and 12C. In this embodiment 40, the unlocking member 9 has a shape different from that used in the first or second embodiment (lighters 1 and 30). In this embodiment 40, when the pivot pin 15*a* of the action lever 15 is moved from the first position to the second position, the unlocking member 9 requires an auxiliary operation in a different direction in addition to the up-down moving operation. Therefore, the igniting operation becomes more complicated and difficult for a child to accomplish.

Figure 3:
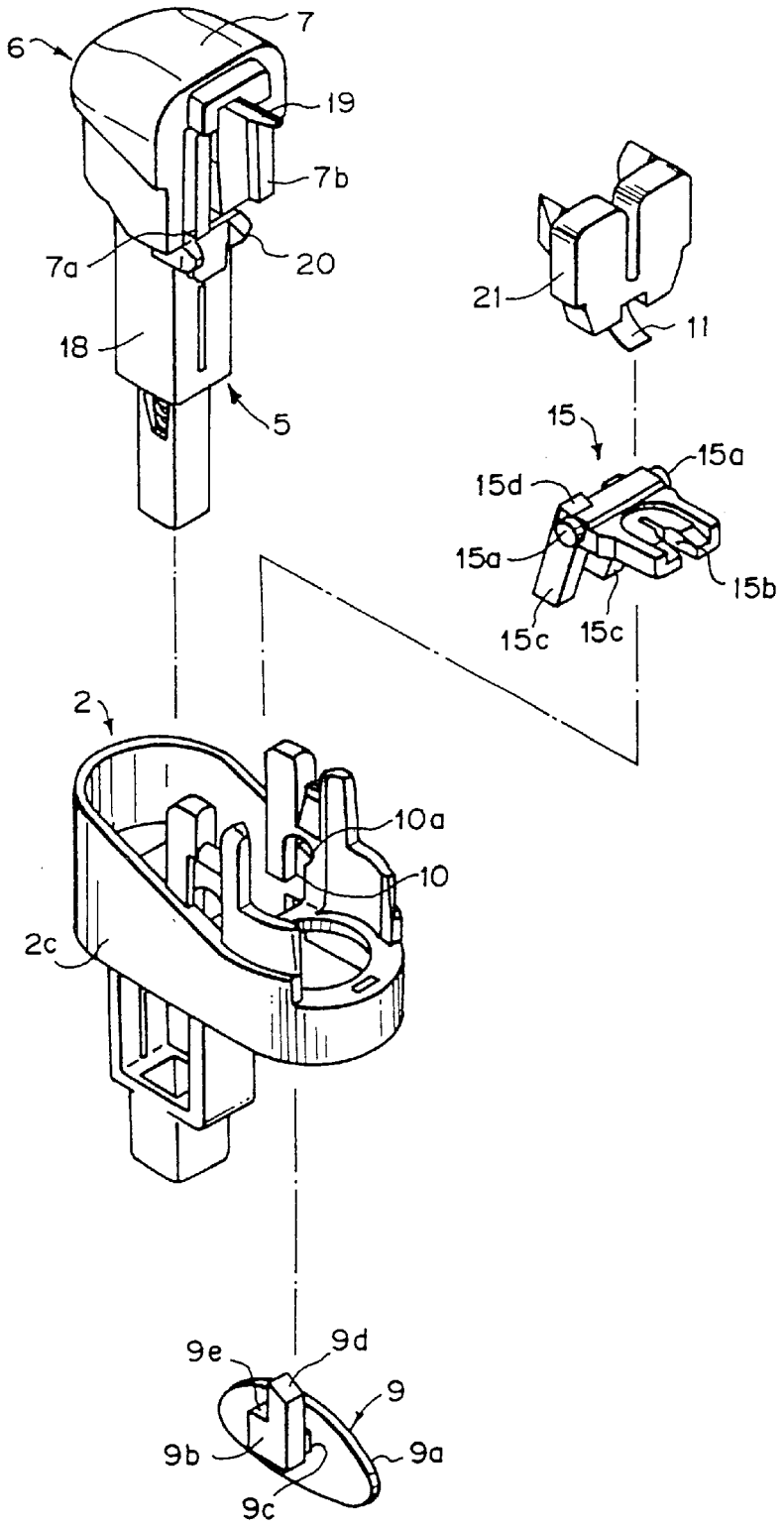
FIG. 3 is an exploded perspective view of the upper portion shown in FIG. 1.

The basic structure of the unlocking member 9 of this embodiment 40 is the same as that in the first embodiment shown in FIG. 3. The unlocking member 9 comprises an operating part 9*a* disposed outside of the lighter main body 2, an interlock part 9*b* carrying a ramp 9d and a stopper shoulder 9*e*, which are disposed inside the lighter main body 2, and a connecting part 9*c* connecting the two parts 9*a* and 9*b*. On the upper portion of the connecting part 9*c*, there is a protrusion 9*f* pointing towards the operating part 9*a*.

The protrusion 9*f* can be engaged with the upper end of a sliding groove 13 formed on the middle case 2*c* of the lighter main body 2. When the protrusion 9*f* is pushed into the lighter, the connecting part 9*c* can move vertically in the sliding groove 13. The interlock part 9*b* is moved upward to arm the lighter when the operating part 9*a* is pushed upward.

Figure 11A:
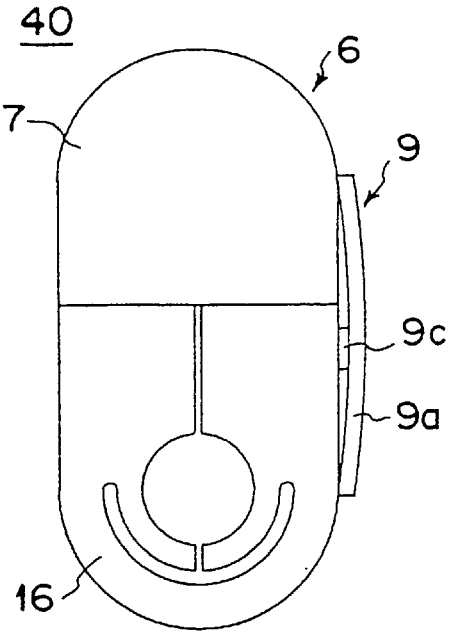
FIG. 11A is a top plan view of the gas lighter of the third embodiment in its locked state.
Figure 11B:
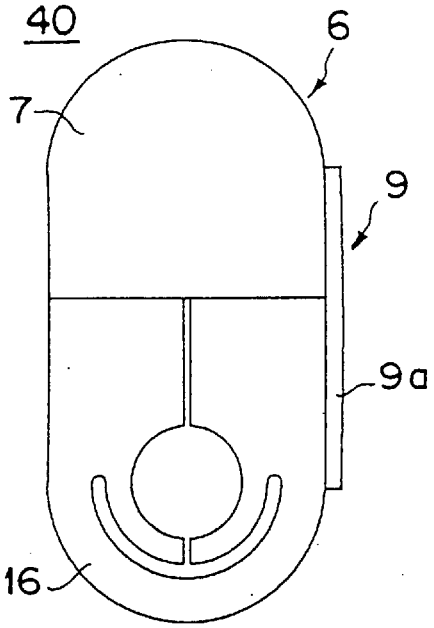
FIG. 11B is a top plan view of the gas lighter of the third embodiment in its unlocked state.

The operating part 9*a* of the unlocking member 9 is formed from an elastic plate. In the normal state, the operating part 9*a* is curved with its opposite side end portions in contact with the side of the lighter main body 2 so that the connecting part 9*c* is pulled outward under the elastic force of the operating part 9*a*, as shown in FIG. 11A. When the operating part 9*a* is pressed inward, the operating part 9*a* becomes flat as shown in FIG. 11B and the connecting part 9*c* is pushed into the inside of gas lighter 40.

The unlocking member 9 acts as follows. When the unlocking member 9 is in the locking position, the protrusion 9*f* is pulled outward under the elastic force of the operating part 9*a* and the upper end portion thereof is in engagement with the upper end of the sliding groove 13. In this state, the unlocking member 9 cannot be moved by simply pushing the operating part 9*a* upward. Further the pivot pin 15*a* of the action lever 15 remains in the first position so that the fuel gas will not be sprayed and the ignition of the lighter 40 is prevented.

Figures 12A, 12B, 12C:
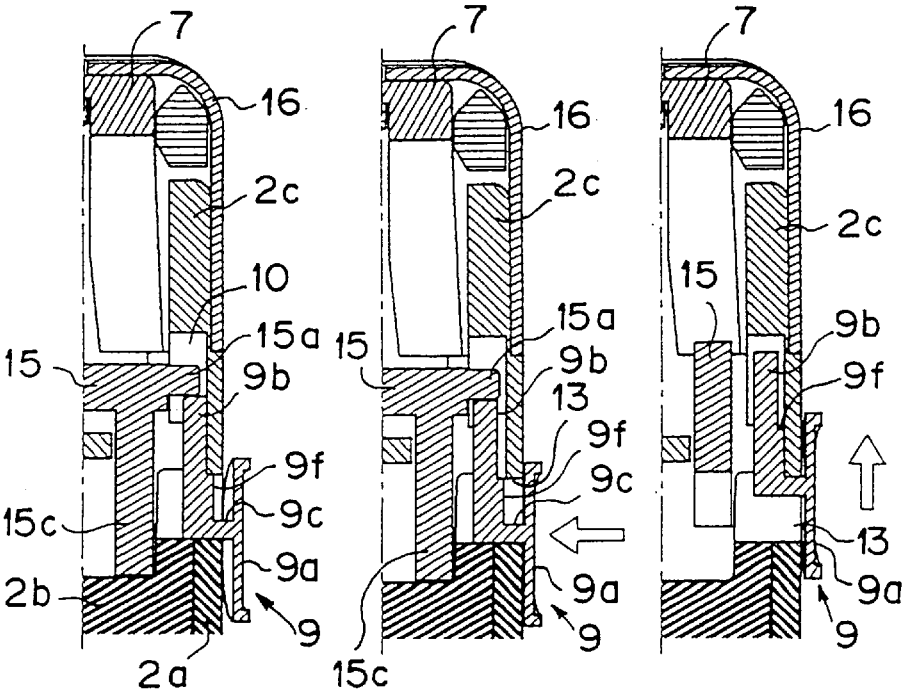
FIGS. 12A, 12B, and 12C are partial cross-sectional views illustrating the unlocking operation process in the gas lighter of the third embodiment.

When using the gas lighter 40, the operating part 9*a* of the unlocking member 9 is pressed flat so that the protrusion 9*f* is released from the sliding groove 13 as shown in FIG. 12B. Then the unlocking member 9 is pushed upward to the unlocking position as shown in FIG. 12C. In response to upward movement of the unlocking member 9, the ramp 9*d* of the unlocking member 9 pushes the pivot pin 15*a* of the action lever 15 from the first position (locked and disarmed) to the second position (unlocked and armed) in the manner described above.

Then the operating cap 7 is pressed downward to pivot the action lever to release the fuel gas and produce an ignition spark. In the latter part of the pressing process, the operating cap 7 is brought into abutment against the stopper shoulder 9*e* on the unlocking member 9 and the unlocking member 9 is pushed downward to a lower position. In the lower position, the protrusion 9*f* is pulled into the sliding groove 13 by the elastic force of the operating part 9*a* and the unlocking member 9 is automatically brought into the original locked and disarmed state.

Fourth Embodiment

A gas lighter 50 in accordance with a fourth embodiment of the present invention is shown in FIGS. 13 to 20. In this embodiment, the unlocking member 51 is first moved in the transverse direction.

In this embodiment, the gas lighter 50 comprises a lighter main body 2, a fuel-supplying device 4 (nozzle 3 and valve mechanism 14), an action lever 15, an igniting means 5 (piezoelectric unit 18), a pressing member 6 (operating cap 7), a retained member 11, and the like which are basically the same as those in the first embodiment, though somewhat different in shape.

Figure 13:
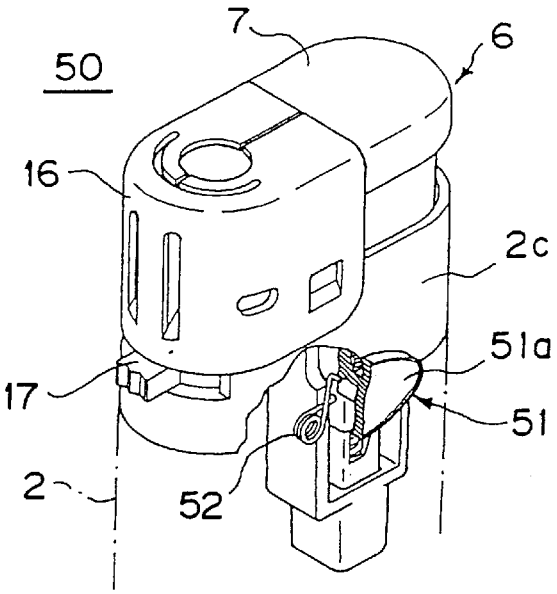
FIG. 13 is a perspective view partly in cross-section of the upper portion of a gas lighter in accordance with a fourth embodiment of the present invention.
Figure 14:
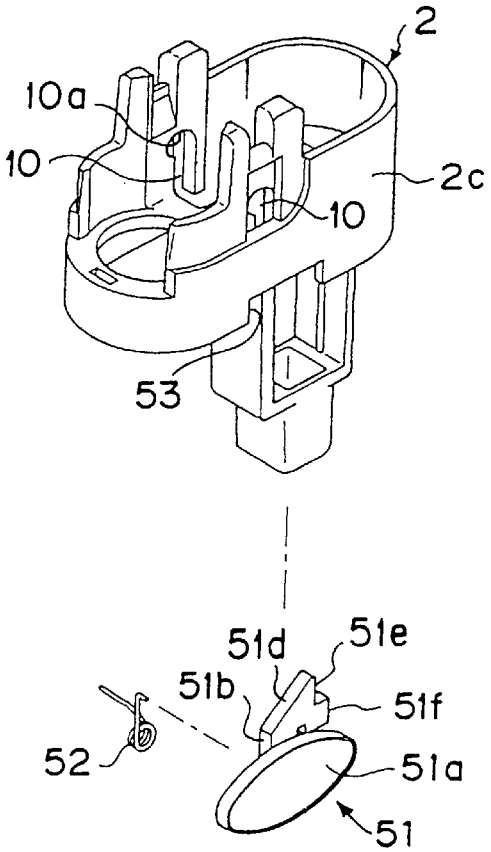
FIG. 14 is a partly exploded perspective view of the part shown in FIG. 13.
Figure 15:
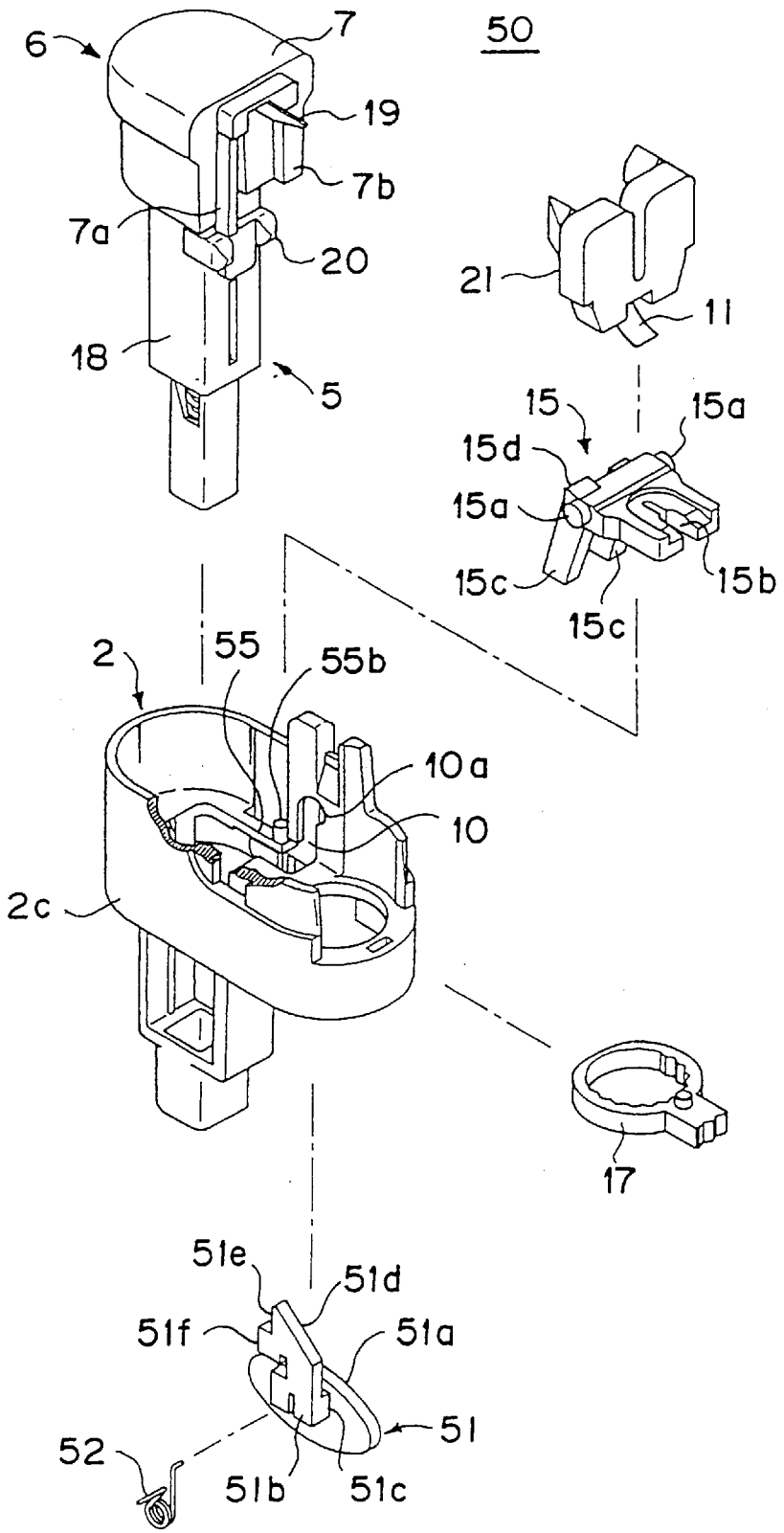
FIG. 15 is a partly exploded perspective view of the upper portion shown in FIG. 13.

In this embodiment, the unlocking member 51 for changing the position of the pivot pin 15*a* of the action lever 15 includes a plate-like operating part 51*a* disposed outside the lighter main body 2 and a sliding part 51*b* inside the lighter main body 2. A connecting part 51*c*, which connects the two parts together, is supported for sliding movement in the transverse direction in a sliding groove 53 formed on the middle case 2*c* of the lighter main body 2. The unlocking member 51 can be moved between an unlocking position on the left side as seen in FIG. 13 and a locking position on the right side.

The sliding part 51*b* of the unlocking member 51 is connected to one end of a return spring 52 formed of a torsion-coil spring. The other end of the return spring 52 is fixed to a part of the middle case 2*c* containing therein the piezoelectric unit 18, thereby urging the unlocking member 51 toward the locking position.

As in the first embodiment, the pivot pin 15*a* of the action lever 15 is movable up and down along the guide grooves 10 formed on the middle case 2*c* of lighter main body 2. When the pivot pin 15 is in the second position where it is received in the semicircular supporting portions 10*a* on the top of the grooves, the action lever 15 can be rotated about the pivot pin 15 to discharge the fuel gas. When the pivot pin 15 is in the first position, the fuel gas cannot be discharged. On the top part close to the pivot pin 15*a* of the action lever 15, there may be an engagement protrusion 15*d* that engages the operating cap 7 to prevent its descent any further than that shown in FIG. 17 when the lighter 50 is locked.

Figure 20:
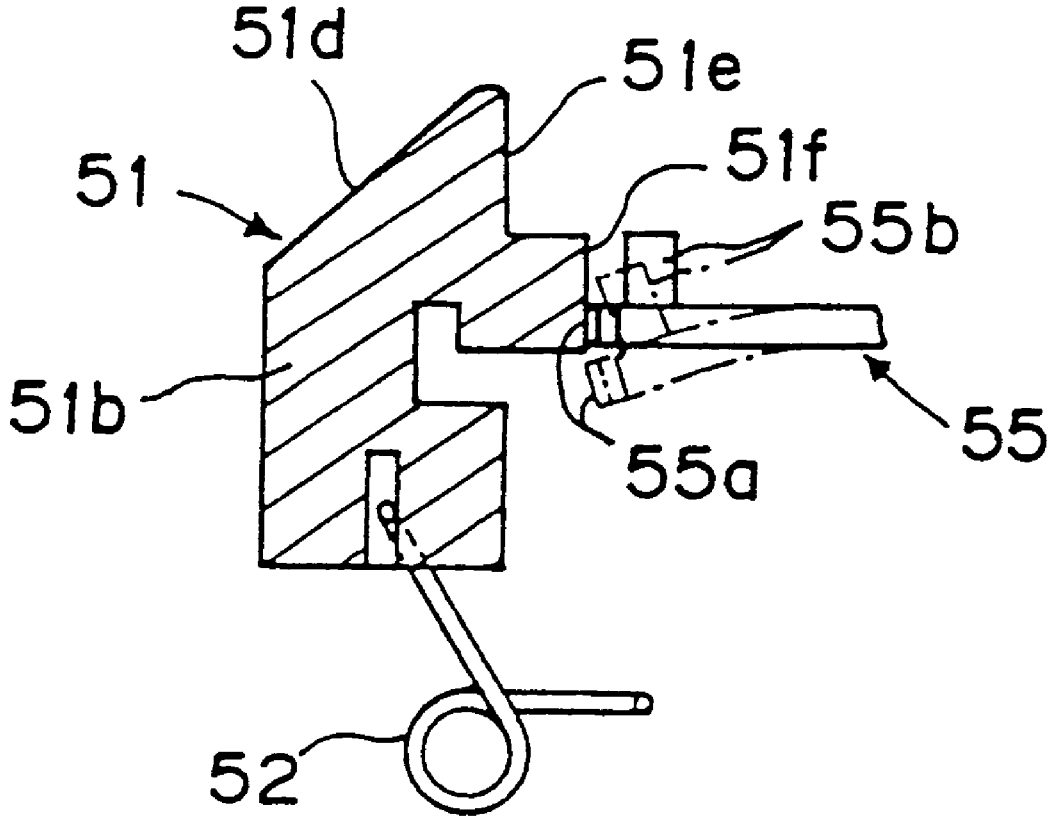
FIG. 20 is an enlarged cross-sectional view of the unlocking member of the gas lighter of the fourth embodiment.

As shown in detail in FIG. 20, the sliding part 51*b* of the unlocking member 51 has a ramp 51*d* on the upper end thereof. The ramp 51*d* can be brought into abutment against the pivot pin 15*a* of the action lever 15 from below to move the pivot pin 15*a* upward from the vertical portions of the guide grooves 10 into the supporting portion 10*a* as well as to move the pivot pin 15*a* in the transverse direction away from the operating cap 7 into engagement with the supporting portion 10*a* of the guide grooves 10. On the back side (right side) of the ramp 51*d,* there is formed an abutment portion 51*e* which can be brought into abutment against the front end face of the operating cap 7. Under the abutment portion 51*e,* there is formed an engagement portion 51*f* which can be brought into engagement with a tip protrusion 55*a* of a locking member 55 to be described later.

The sliding part 51*b* is laterally movable along the inner surface of a supporting part on the side wall of the middle case 2*c*. In the further inner side of the moving part, there is located the locking device 55 described above, which extends in the direction that the sliding part 51*b* moves. The end portion of the locking member 55 facing the nozzle 3 can be resiliently deformed up and down. That is, the sliding part 51*b* moves between the locking device 55 and the inner surface of the side wall. When the unlocking member 51 is moved to the unlocking position, the outer end face of the engagement portion 51*f* is brought into engagement with the protrusion 55*a* formed on the tip part of the locking device 55 to project toward the side wall (see FIG. 18). When the unlocking member 51 goes back to the locking position, the protrusion 55*a* is engaged with the inner end face of the engagement portion 51*f* (see FIG. 16).

A releasing button 55*b* projects upward from the upper surface of the tip part of the locking device 55. A lower side surface of the operating cap 7 is brought into abutment against an upper end portion of the releasing button 55*b* and when the operating cap 7 is brought into abutment against the releasing button 55*b,* the locking member 55 deforms as shown by the dashed line in FIG. 20, whereby the protrusion 55*a* of the locking member 55 is disengaged from the outer end face of the engagement portion 51*f* on the sliding part 51*b* so that the spring 52 can move the unlocking member 51 back to its locked position.

Figure 16:
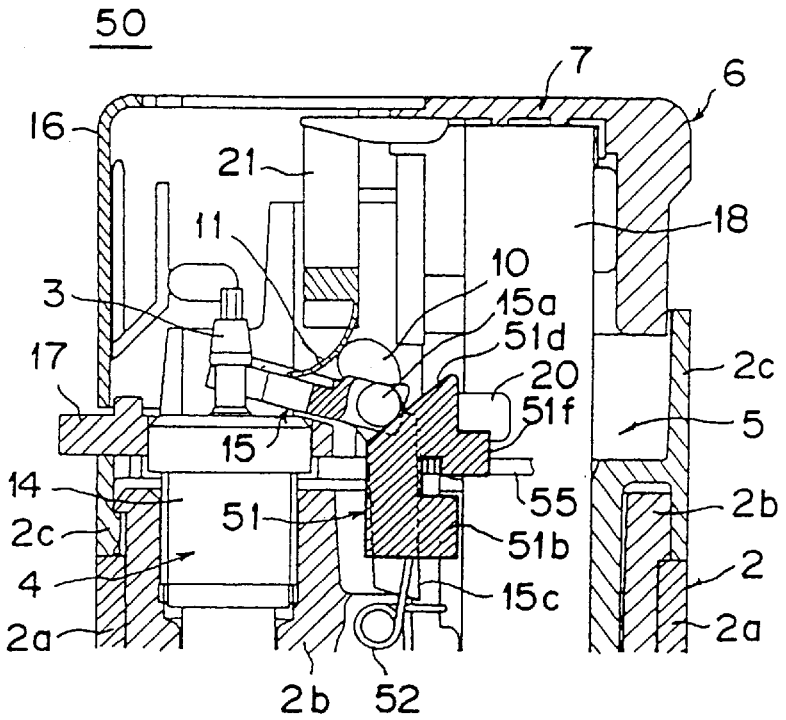
FIG. 16 is a vertical cross-sectional view of the upper portion of the gas lighter shown in FIG. 13 in its locked condition.
Figure 17:
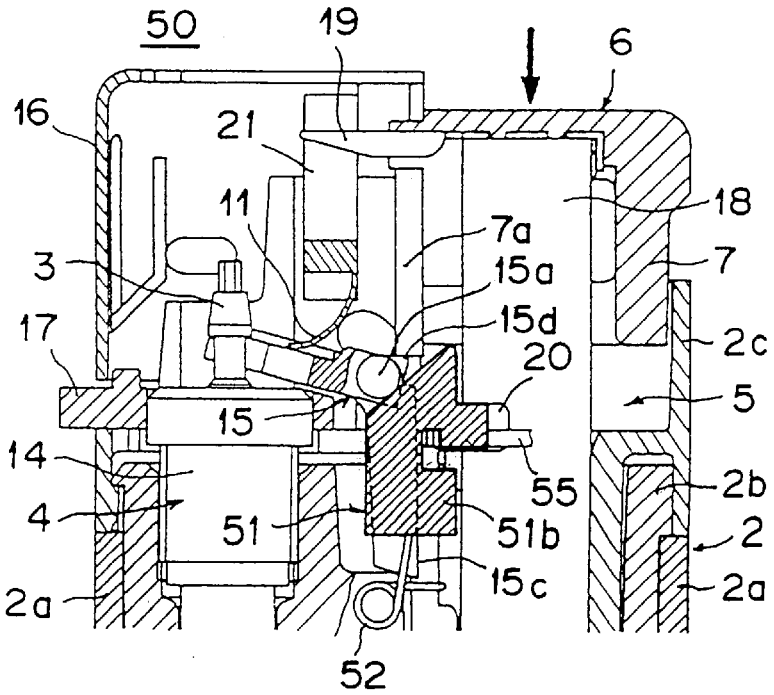
FIG. 17 is a vertical cross-sectional view of the upper portion of the gas lighter shown in FIG. 13 in its locked condition wherein further movement of the pressing device is blocked by the unlocking device.
Figure 18:
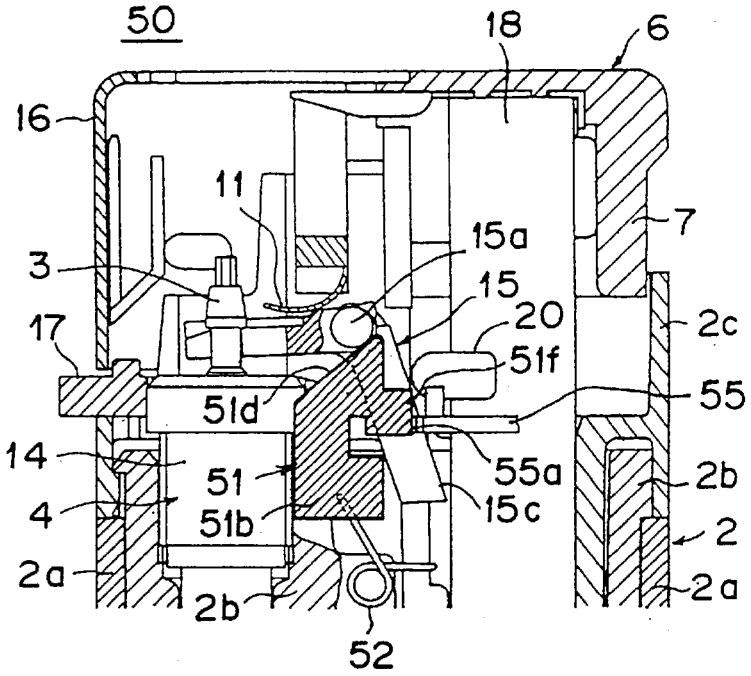
FIG. 18 is a vertical cross-sectional view of the upper portion of the gas lighter shown in FIG. 13 in its unlocked condition where the unlocking device has been moved to move the action lever into its operative position.

The operation of the gas lighter of this embodiment will be described with reference to FIGS. 16 to 19, hereinbelow. When the unlocking member 51 is in the locking position on the right as shown in FIG. 16, the pivot pin 15*a* of the action lever 15 is in the first position, where the leg portions 15*c* of the action lever 15 extend substantially straight downward and are held in positions where they cannot be brought into contact with the lever press 20 with the lower end portions thereof in abutment against the cap 7. When operation cap 7 is pressed downward in this state, the first abutment member 7*a* on the cap 7 is brought into abutment against the protrusion 15*d* on the action lever 15 and the lower side surface of the operating cap 7 is brought into abutment against the upper end portion of the ramp 51*d* of the unlocking member 51 as shown in FIG. 17. Accordingly, further depression of the operating cap 7 is prevented, and the lighter is locked and neither discharge nor ignition of the fuel gas can be accomplished.

In case the operating cap 7 is broken in such a manner that depression of the operating cap 7 becomes feasible even if the pivot pin 15*a* is in the first position, depression of the operating cap 7 cannot rotate the action lever 15 since the leg portions 15*c* of the action lever 15 are held in positions where they cannot be brought into contact with the lever press 20 so long as the pivot pin 15*a* is in the first position. Accordingly the fuel gas is not discharged and ignited even if the piezoelectric unit 18 discharges to produce a spark.

When the gas lighter 50 is to be used, the operating part 51*a* of the unlocking member 51 is moved left in the transverse direction to the unlocking position. When the unlocking member 51 is moved left, the ramp 51*d* on the unlocking member 51 pushes the pivot pin 15*a* of the action lever 15 upward from the vertical portions of the guide grooves 10 to the supporting portions 10*a* on the top of the grooves 10 and then forward into engagement with the supporting portions 10*a* (the second position). In the second position, the action lever 15 is rotatable about the pivot pin 15*a*. At the same time, the protrusion 55*a* on the locking member 55 is engaged with the outer end portion of the engagement portion 51*f* on the unlocking member 51, whereby the locking member 55 is held sidewardly in the position.

When the pivot pin 15*a* is in the second position, the first abutment member 7*a* on the operating cap 7 cannot act on the protrusion 15*d* on the action lever 15 since the action lever 15 has moved away from the cap 7. Further the nozzle engaging groove of the action lever 15 is in a substantially horizontal position and the leg portions 15*c* incline obliquely rearward where the lever press 20 can act on the leg portions 15*c*.

Figure 19:
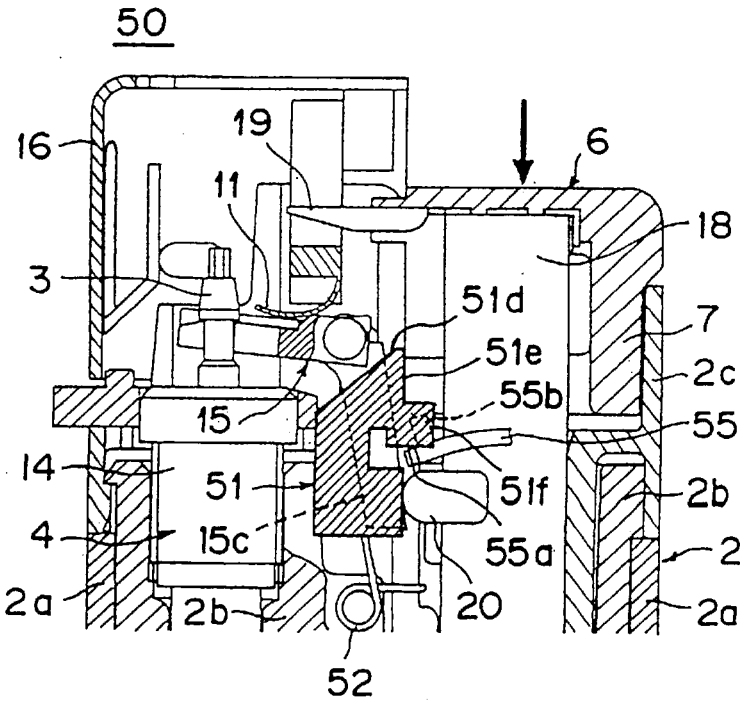
FIG. 19 is a vertical portion view of the upper portion of the gas lighter shown in FIG. 13 with the action lever causing release of fuel and the unlocking device being moved to its locked position by pressing of the pressing device.

When the operating cap 7 is pressed downward with the unlocking member 9 held in the unlocking position, the lever press 20 is brought into abutment against the leg portions 15*c* of the action lever 15, as shown in FIG. 19, and turns the action lever 15 to open the valve mechanism 14 in the fuel supplying device 4, so that the fuel gas is discharged through the nozzle 3. At the same time, the lever press 20 drives the piezoelectric unit 18 to ignite the fuel gas. Further, during the latter part of the pressing action, the lower side surface of the operating cap 7 is brought into abutment against the releasing button 55*b* of the locking member 55 to deform the locking member 55 and disengage the protrusion 55*a* of the locking member 55 from the engagement portion 51*f* on the sliding part 51*b*. Accordingly the unlocking member 51 is moved left to the locking position under the force of the return spring 52 and is stopped when the abutment portion 51*e* abuts against the front face of the operating cap 7.

When the unlocking member 51 moves rightward, the ramp 51*d* on the unlocking member 51 can no longer hold the pivot pin 15*a* of the action lever 15. However, the pivot pin 15*a* of the action lever 15 is held in the second position without falling from the supporting portions 10*a* by a combined force of the counter-force to the force pushing upward on the nozzle 3 and the pressing force from the lever press 20 acting on the action lever 15. Thus the valve mechanism 14 is kept open and the flame is maintained.

When the operating cap 7 is released to quench the flame, the operating cap 7 is returned to the original upper position under the force of the spring built in the piezoelectric unit 18 and the like. Then the counter-forces acting on the action lever 15 disappear, and the action lever 15 is pushed away from the supporting portions 10*a* under the force of the retainer member 11. Thus the pivot pin 15*a* of the action lever 15 is returned from the second position to the first position, and since the unlocking member 51 is already in the locking position, the lighter is returned to the locked state.

Thus, there has been shown novel lighters which fulfill all of the objects and advantages sought therefor. Many changes, alterations, modifications and other uses and applications of the subject invention will become apparent to those skilled in the art after considering the specification together with the accompanying drawings. All such changes, alterations and modifications which do not depart from the spirit and scope of the invention are deemed to be covered by the invention which is limited only by the claims that follow.

What is claimed is:

1. A lighter comprising:

a body for storing fuel;

a nozzle;

a valve system for communicating fuel from said body to said nozzle when opened;

an action lever operatively connected to said valve system for opening said valve system, said action lever including:

an axis of rotation having:

a first unsupported position; and a second supported position;

ignition means for igniting fuel discharged through the nozzle when said nozzle is opened;

a pressing member, which when depressed drives said action lever and said ignition means; and an unlocking member, which is manually operable to move said axis of rotation of said action lever from said first unsupported position where said action lever is incapable of opening said valve system to said second supported position where said action lever is capable of opening said valve system when driven by said pressing member.

2. The lighter as defined in claim 1 in which said unlocking member and said pressing member each include:

a facing abutment surface, said facing abutment surfaces engage when said valve system is opened to move said unlocking member to a position where said axis of rotation of said action lever moves to said first unsupported position.

3. The lighter as defined in claim 1 further including:

a biasing member provided in engagement with said action lever to urge said axis of rotation of said action lever to move toward said first unsupported position.

4. The lighter as defined in claim 1 wherein said pressing member includes:

an abutment surface, and said action lever includes:

an engaging protrusion positioned so that when said action lever is in said first unsupported position, said pressing member is restricted in movement by contact between said engaging protrusion and said abutment surface, to thereby provide tactile feedback of inoperability of said lighter.

5. The lighter as defined in claim 1 wherein said pressing member and said action lever are positioned so said pressing member, when pressed, cannot be brought into contact with said action lever when said axis of rotation of said action lever is in said first unsupported position, thereby preventing release of fuel.

6. The lighter as defined in claim 1 wherein said action lever includes:

at least one pivot pin aligned with said axis of rotation, said lighter further including:

at least one guide groove for guiding the position of said at least one pivot pin, said at least one guide groove having:

a semicircular top portion for positioning said axis of rotation in said second supported position; and a lower portion extending away from said semicircular top portion for positioning said axis of rotation in said first unsupported position.

7. The lighter as defined in claim 1 wherein said unlocking device includes:

a curved elastic plate-like operating portion; and a protrusion engaged with said body in a stationary position to restrict the vertical movement whereby said protrusion is released from said body in response to a pressing operation of said operating portion that tends to straighten said curved elastic plate-like operating portion against said body.

8. A lighter comprising:

a main body for storing fuel;

a nozzle;

a valve system;

fuel-supplying means for supplying the fuel from said main body to said nozzle through said valve system;

an action lever for opening said valve system with said action lever being connected to said valve system including:

a lever axis;

ignition means for igniting fuel discharged through said nozzle; and a pressing member which when depressed slides along said action lever and operates said ignition means, characterized by further having:

an unlocking member operated with respect to said main body to move said lever axis from a locking position incapable of operating said valve system to a unlocked position capable of operating said valve system; and biasing means which urge said unlocking member toward the locking position.

9. The lighter as defined in claim 8 further including:

an unlocking member: and a locking member, wherein said unlocking member is locked in the unlocking position by said locking member and released from said locking member in response to depression of said pressing member.

10. A method for providing child resistancy that is difficult to permanently defeat to a lighter that includes a body for storing fuel, a fuel burner, a valve system for supplying fuel from the body to the fuel burner, an valve system lever connected to the valve system for opening, a manually movable actuator separate from the valve system lever, and an arming device which is adapted for manual movement when the user of the lighter wishes to generate a flame, the method including:

establishing an operable connection between the valve system lever and the manually movable actuator to release fuel through the fuel burner by:

moving the arming device to an armed position; and moving the arming device to a disarmed position by:

moving the manually movable actuator when an operable connection between the valve system lever and the manually movable actuator has been established to release fuel through the fuel burner.

11. The method as defined in claim 10 wherein said moving of the arming device first requires:

an auxiliary moving operation in a direction different from the direction of the said moving of the arming device to an armed position.

12. The method as defined in claim 11 wherein said auxiliary moving operation is a pressing operation.

13. The method as defined in claim 10 further including:

blocking at least a portion of the movement of the manually movable actuator when the arming device is in a disarmed position, whereby the user can feel the inoperative condition of the lighter.

14. The method as defined in claim 10 further including:

allowing complete movement of the manually movable actuator when the arming device is in a disarmed position to hide the inoperative condition of the lighter.

15. The method as defined in claim 10 further including:

operatively connecting a piezoelectric spark producing unit to the manually movable actuator so that a spark is produced adjacent the fuel burner when the manually movable actuator is moved to a position where the valve system is open if the arming device had been moved to its armed position.

16. The method as defined in claim 10 further including:

providing the arming device spaced from the manually movable actuator.

17. The method as defined in claim 10 further including:

providing the operable connection between the manually movable actuator and the valve system lever generally centrally over the lighter body where access thereto is restricted by surrounding structure.

18. The method as defined in claim 10 wherein said moving the arming device to an armed position includes:

moving the arming device in a first direction; and then moving the arming device in a second direction different from the first direction.

19. The method as defined in claim 18 wherein said moving the arming device in a first direction is moving the arming device sidewardly with respect to the body, and wherein said moving the arming device in a second direction is moving the arming device longitudinally with respect to the body.

20. The method as defined in claim 18 wherein said moving the arming device in a first direction is moving the arming device inwardly with respect to the body, and wherein said moving the arming device in a second direction is moving the arming device longitudinally with respect to the body.

21. The method as defined in claim 20 wherein said moving the arming device in a second direction is moving the arming device longitudinally with respect to the body.

22. The method as defined in claim 10 further including:

operatively connecting a spark producing unit to the manually movable actuator so that a spark is produced adjacent the fuel burner when the manually movable actuator has been moved to a position where the valve system will be open if the arming device has been moved to the armed position.

23. A child resistant actuation system that is difficult to permanently defeat for a gas lighter that includes a fuel storage tank, a fuel burner, a valve system for supplying fuel from the tank to the fuel burner, and an actuator which is adapted for manual movement when the user of the lighter wishes to generate a flame at the fuel burner, said actuation system including:

a pair of cams that establish a two dimensional path having:

a first path portion that establishes the two dimensional path in a first direction; and a second path portion that establishes the two dimensional path in a second direction different from the first direction;

a lever connected to the valve system for opening the valve system, said lever including:

a first end adapted for connection to the valve system;

a pair of cam followers that are positioned in said pair of cams; and a second end adapted for interruptable connection to the actuator; and an arming device for establishing a connection between said lever and the actuator, said arming device including:

a first surface to force said pair of cam followers into the second path portion where said lever is restrained to pivot with said second end in position to be moved by movement of the actuator.

24. The child resistant actuation system as defined in claim 23 further including:

biasing means in contact with said lever to urge said pair of cam followers into said first path portion from said second path portion.

25. The child resistant actuation system as defined in claim 23 wherein said lever first end is at an angle to said second end, said second end including:

a sliding side surface thereon for sliding contact with the actuator thereby providing force amplification to the connection between said lever and the actuator.

26. The child resistant actuation system as defined in claim 23 wherein said arming device includes:

a disarming abutment surface thereon positioned for contact with the actuator when the actuator is manually moved to move said arming device to said disarmed position.

27. The child resistant actuation system as defined in claim 23 wherein said arming device includes:

a manually movable button;

biasing means to urge said manually movable button outwardly; and an abutment surface that must be moved inwardly to allow arming movement of said arming device, whereby said manually movable button must be forced inwardly during the arming of said arming device.

28. The child resistant actuation system as defined in claim 23 wherein said lever includes:

an abutment surface adjacent said pair of cams positioned for restricting actuator movement when said pair of cams are in said first path portion.

29. The child resistant actuation system as defined in claim 23 wherein said first surface is canted to first force said pair of cam followers along said first path portion into said second path portion, said system further including:

biasing means in contact with said lever to urge said pair of cam followers into said first path portion from said second path portion.

30. The child resistant actuation system as defined in claim 29 wherein said lever first end is at an angle to said second end, said second end including:

a sliding side surface thereon for sliding contact with the actuator thereby providing force amplification to the connection between said lever and the actuator.

31. The child resistant actuation system as defined in claim 30 wherein said arming device includes:

a disarming abutment surface thereon positioned for contact with the actuator when the actuator is manually moved to move said arming device to said disarmed position.

32. The child resistant actuation system as defined in claim 23 further including:

biasing means in contact with said lever to urge said pair of cam followers into said first path portion from said second path portion, wherein said lever first end is at near a 90° angle to said second end, said second end including:

a sliding side surface thereon for sliding contact with the actuator thereby providing force amplification to the connection between said lever and the actuator.

33. The child resistant actuation system as defined in claim 23 wherein said first surface is canted to first force said pair of cam followers along said first path portion into said second path portion.

34. A child resistant actuation system that is difficult to permanently defeat for a gas lighter that includes a fuel storage tank, a fuel burner, a valve system for supplying fuel from the tank to the fuel burner, and an actuator which is adapted for manual movement in a first actuator direction when the user of the lighter wishes to generate a flame at the fuel burner, the actuation system including:

arming means having:

an armed position: and a disarmed position; and correction means separate from the actuator operatively connected to said arming means to establish a physical connection between the valve system and the actuator when said arming means are in said armed position.

35. The system as defined in claim 34 further including:

means to move said arming means to said disarmed position after each time said connection means have established a physical connection between the valve system and the actuator and the valve system has supplied fuel to the fuel burner.

36. The system as defined in claim 34 wherein said connection means include:

a lever connected to the valve system, said lever including:

an interruptable sliding connection to the actuator.

37. The system as defined in claim 36 wherein said connection means further include:

first biasing means to urge said lever generally in the first actuator direction; and a pair of grooves each having:

a linear portion extending generally parallel to the first actuator direction; and a semicircular support portion, and wherein said lever includes:

an axle, about which said lever is pivotable, positioned in said pair of grooves, said first biasing means urging said lever so that said axle tends to be positioned in said linear portion, said axle being in said semicircular support portion when said arming means is in said armed position and in said linear portion when said arming means is in said disarmed position.

38. The system as defined in claim 37 wherein said arming means further include:

at least one wedge positioned to engage said axle, whereby when said arming button is moved to said second position, said axle is forced into said semicircular support portion.

39. The system as defined in claim 37 wherein said arming means include:

an arming button positioned for manual movement, said arming button having:

a first position to establish said disarmed position of said arming means; and a second position to establish said armed position of said arming means.

40. The system as defined in claim 39 wherein said arming button includes:

a stressed button plate that biases said button outwardly.

41. A lighter comprising:

a body for storing fuel;

a nozzle;

a valve system for communicating fuel from said body to said nozzle when opened;

an action lever operatively connected to said valve system for opening said valve system, said action lever including:

an axis of rotation;

ignition means for igniting fuel discharged through the nozzle when said nozzle is opened;

a pressing member, which when depressed drives said action lever and said ignition means; and an unlocking member, which is manually operable to move said axis of rotation of said action lever from a first position where said action lever is incapable of opening said valve system to a second position where said action lever is capable of opening said valve system when driven by said pressing member, said pressing member Including:

an abutment surface, and said action lever includes:

an engaging protrusion positioned so that when said action lever is in the first position, said pressing member is blocked by abutment contact between said engaging protrusion and said abutment surface, to thereby provide tactile feedback of inoperability of said lighter.

42. A lighter comprising a body for storing fuel;

a nozzle;

a valve system for communicating fuel from said body to said nozzle when opened;

an action lever operatively connected to said valve system for opening said valve system, said action lever including:

an axis of rotation;

ignition means for igniting fuel discharged through the nozzle when said nozzle is opened;

a pressing member, which when depressed drives said action lever and said ignition means; and an unlocking member, which is manually operable to move said axis of rotation of said action lever from a first position where said action lever is incapable of opening said valve system to a second position where said action lever is capable of opening said valve system when driven by said pressing member, wherein said pressing member and said action lever are positioned so said pressing member, when pressed, cannot be brought into contact with said action lever when said axis of rotation of said action lever is in the first position, thereby preventing release of fuel.

43. A lighter comprising a body for storing fuel;

a nozzle;

a valve system for communicating fuel from said body to said nozzle when opened;

an action lever operatively connected to said valve system for opening said valve system, said action lever including:

an axis of rotation;

ignition means for igniting fuel discharged through the nozzle when said nozzle is opened;

a pressing member, which when depressed drives said action lever and said ignition means; and an unlocking member, which is manually operable to move said axis of rotation of said action lever from a first position where said action lever is incapable of opening said valve system to a second position where said action lever is capable of opening said valve system when driven by said pressing member, wherein said unlocking device includes:

a curved elastic plate-like operating portion; and a protrusion engaged with said body in a stationary position to restrict the vertical movement whereby said protrusion is released from said body in response to a pressing operation of said operating portion that tends to straighten said curved elastic plate-like operating portion against said body.

44. A method for providing child resistancy that is difficult to permanently defeat to a lighter that includes a body for storing fuel, a fuel burner, a valve system for supplying fuel from the body to the fuel burner, an valve system lever connected to the valve system for opening, a manually movable actuator and an arming device which is adapted for manual movement when the user of the lighter wishes to generate a flame, the method including:

establishing an operable connection between the valve system lever and the manually movable actuator to release fuel through the fuel burner by:

moving the arming device to an armed position; and moving the arming device to a disarmed position by:

moving the manually movable actuator when an operable connection between the valve system lever and the manually movable actuator has been established to release fuel through the fuel burner, wherein said moving of the arming device first requires:

an auxiliary moving operation in a direction different from the direction of the said moving of the arming device to an armed position, said auxiliary moving operation being:

a pressing operation.

45. A method for providing child resistancy that is difficult to permanently defeat to a lighter that includes a body for storing fuel, a fuel burner, a valve system for supplying fuel from the body to the Fuel burner, an valve system lever connected to the valve system for opening, a manually movable actuator and an arming device which is adapted for manual movement when the user of the lighter wishes to generate a flame, the method including:

establishing an operable connection between the valve system lever and the manually movable actuator to release fuel through the fuel burner by:

moving the arming device to an armed position; and moving the arming device to a disarmed position by:

moving the manually movable actuator when an operable connection between the valve system lever and the manually movable actuator has been established to release fuel through the fuel burner, wherein said moving the arming device to an armed position includes:

moving the arming device in a first direction; and then moving the arming device in a second direction different from the first direction.

46. The method as defined in claim 45 wherein said moving the arming device in a first direction is moving the arming device sidewardly with respect to the body, and wherein said moving the arming device in a second direction is moving the arming device longitudinally with respect to the body.

47. The method as defined in claim 45 wherein said moving the arming device in a first direction is moving the arming device inwardly with respect to the body, and wherein said moving the arming device in a second direction is moving the arming device longitudinally with respect to the body.

48. The method as defined in claim 47 wherein said moving the arming device in a second direction is moving the arming device longitudinally with respect to the body.

49. A child resistant actuation system that is difficult to permanently defeat for a gas lighter that includes a fuel storage tank, a fuel burner, a valve system for supplying fuel from the tank to the fuel burner, and an actuator which is adapted for manual movement in a first actuator direction when the user of the lighter wishes to generate a flame at the fuel burner, the actuation system including:

arming means having:

an armed position: and a disarmed position; and connection means to establish a physical connection between the valve system and the actuator when said arming means are in said armed position, wherein said connection means include:

a lever connected to the valve system, said lever including:

an interruptable sliding connection to the actuator.

50. The system as defined in claim 49 wherein said connection means further include:

first biasing means to urge said lever generally in the first actuator direction; and a pair of grooves each having:

a linear portion extending generally parallel to the first actuator direction; and a semicircular support portion, and wherein said lever includes:

an axle, about which said lever is pivotable, positioned in said pair of grooves, said first biasing means urging said lever so that said axle tends to be positioned in said linear portion, said axle being in said semicircular support portion when said arming means is in said armed position and in said linear portion when said arming means is in said disarmed position.

51. The system as defined in claim 50 wherein said arming means further include:

at least one wedge positioned to engage said axle, whereby when said arming button is moved to said second position, said axle is forced into said semicircular support portion.

52. The system as defined in claim 50 wherein said arming means include:

an arming button positioned for manual movement, said arming button having:

a first position to establish said disarmed position of said arming means; and a second position to establish said armed position of said arming means.

53. The system as defined in claim 52 wherein said arming button includes;

a stressed button plate that biases said button outwardly.

54. A lighter comprising:

a body for storing fuel;

a nozzle;

a valve system for communicating fuel from said body to said nozzle when opened;

an action lever operatively connected to said valve system for opening said valve system, said action lever including:

an axis of rotation;

ignition means for igniting fuel discharged through the nozzle when said nozzle is opened;

a pressing member, which when depressed slides on said action lever and drives said ignition means; and an unlocking member, which is manually operable to move said axis of rotation of said action lever from a first position where said action lever is incapable of opening said valve system when slid on by said pressing member to a second position where said action lever opens said valve system when slid on by said pressing member.

* * * * *